US008971789B2

(12) United States Patent
Hara

(10) Patent No.: US 8,971,789 B2
(45) Date of Patent: Mar. 3, 2015

(54) DEVELOPMENT DEVICE AND IMAGE FORMING APPARATUS

(71) Applicant: Oki Data Corporation, Tokyo (JP)

(72) Inventor: Shinjiro Hara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 124 days.

(21) Appl. No.: 13/630,050

(22) Filed: Sep. 28, 2012

(65) Prior Publication Data

US 2013/0084118 A1 Apr. 4, 2013

(30) Foreign Application Priority Data

Sep. 29, 2011 (JP) ..... 2011-215376

(51) Int. Cl.
*G03G 15/00* (2006.01)
*G03G 15/20* (2006.01)
*G03G 15/08* (2006.01)

(52) U.S. Cl.
CPC ..... *G03G 15/0896* (2013.01); *G03G 15/6558* (2013.01)
USPC ..... 399/400

(58) Field of Classification Search
CPC ..... G03G 15/20; G03G 15/00
See application file for complete search history.

(56) References Cited

U.S. PATENT DOCUMENTS

| | | | | | |
|---|---|---|---|---|---|
| 5,546,161 | A * | 8/1996 | Sakai et al. | ..... | 399/16 |
| 5,752,149 | A * | 5/1998 | Yuza et al. | ..... | 399/329 |
| 2004/0190935 | A1 * | 9/2004 | Sato | ..... | 399/111 |
| 2006/0182479 | A1 * | 8/2006 | Miyake | ..... | 399/400 |
| 2009/0003910 | A1 * | 1/2009 | Kobayashi | ..... | 399/400 |
| 2009/0285599 | A1 * | 11/2009 | Isokawa | ..... | 399/111 |
| 2009/0297242 | A1 * | 12/2009 | Kanematsu | ..... | 399/400 |

FOREIGN PATENT DOCUMENTS

| | | | | | |
|---|---|---|---|---|---|
| JP | 63204283 | A * | 8/1988 | ..... | G03G 15/14 |
| JP | 02-082269 | A | 3/1990 | | |
| JP | 04034482 | A * | 2/1992 | ..... | G03G 15/20 |
| JP | 05323814 | A * | 12/1993 | ..... | G03G 15/20 |
| JP | 06342232 | A * | 12/1994 | ..... | G03G 15/00 |
| JP | 07-191511 | A | 7/1995 | | |
| JP | 07-237777 | A | 9/1995 | | |
| JP | 08-006328 | A | 1/1996 | | |
| JP | 08006328 | A * | 1/1996 | ..... | G03G 15/20 |
| JP | 11-338290 | A | 12/1999 | | |
| JP | 2002-072696 | A | 3/2002 | | |
| JP | 2009-007080 | A | 1/2009 | | |

* cited by examiner

*Primary Examiner* — Nguyen Ha
(74) *Attorney, Agent, or Firm* — Muncy, Geissler, Olds & Lowe, P.C.

(57) ABSTRACT

A development device includes a development part configured to develop a developer image on a surface of an electrostatic latent image carrier based on an image signal, a transfer part configured to transfer the developer image to a medium; and a guide part configured to regulate a contact of the medium, on which the developer image has been transferred and been exited, to a housing of the development part, and to guide the medium to a carrying path.

16 Claims, 10 Drawing Sheets

DEVELOPMENT DEVICE AND IMAGE FORMING APPARATUS

CROSS REFERENCE TO RELATED APPLICATION

The present application is related to, claims priority from and incorporates by reference Japanese Patent Application No. 2011-215376, filed on Sep. 29, 2011.

TECHNICAL FIELD

The present invention relates to a development device and an image forming apparatus. For example, the present invention may be applied in the image forming apparatus that forms an image on a medium and the development device that configures the image forming apparatus.

BACKGROUND

In a conventional image forming apparatus, a development device forms a toner image on a medium. The medium on which the unfixed toner image is formed is carried to a fuser. The fuser fixes the unfixed toner image on the medium.

The medium from the development device can be curled since a pressure is applied to the medium by various rollers. Accordingly, the medium cannot be correctly carried to a fuser and thereby the unfixed toner image can be scraped, or a jam of the medium can occur prior to the fixture of the toner image.

Japanese Laid-Open Patent Application Nos. H11-338290 and 2009-7080 describe a guide means that correctly guides a curled medium to a fuser while the medium is carried from a development device to the fuser.

The above-discussed Japanese Laid-Open Patent Application Nos. H11-338290 and 2009-7080 recite that the medium, which is to be carried to the fuser, is guided so that the medium is correctly carried to the fuser.

However, even immediately after the medium has been exited from the development device, the curled medium touches a housing of the development device on the medium exit side. Thereby, the unfixed toner image on the medium surface can be scraped.

For example, degrees of the curls on media significantly differ depending on qualities of the media used. For example, in a case when a recycled sheet or special sheet is used as media, a large curl can be generated. When a medium having such curl is exited from the development device, the medium can contact the housing of the development device.

In such a case, when the toner image has been transferred to the medium by a transfer part and when the medium has been exited from the development device, the curled medium surface touches the housing that is on the downstream side of the exit and thereby an image scrape can occur, meaning that the unfixed toner image on the medium surface is scraped.

Therefore, one of objects of the present invention is to provide a development device and an image forming apparatus that prevent a curled medium from contacting a housing of the development device on a medium exit side and an unfixed toner image on the medium surface from being scraped after the medium has been exited from the development device.

SUMMARY

Considering the above drawbacks, a development device of the invention includes a development part configured to develop a developer image on a surface of an electrostatic latent image carrier based on an image signal, a transfer part configured to transfer the developer image to a medium; and a guide part configured to regulate a contact of the medium, on which the developer image has been transferred and been exited, to a housing of the development part, and to guide the medium to a carrying path.

In another view of the invention, an image forming apparatus is provided, including a development part configured to develop a developer image on a surface of an electrostatic latent image carrier based on an image signal, a transfer part configured to transfer the developer image to a medium, a fusion part configured to fix the developer image that has been transferred to the medium on the medium, and a guide part configured to regulate a contact of the medium, on which the developer image has been transferred and been exited, to a housing of the development part, and to guide the medium to a carrying path to the fusion part.

According to the present invention, the curled medium is prevented from contacting the housing of the development device on the medium exit side after the medium has been exited from the development device, and the unfixed toner image (developer image) on the medium surface from being scraped.

DETAILED DESCRIPTION OF EMBODIMENTS

(A) First Embodiment

A development device and an image forming apparatus according to a first embodiment of the present invention are explained in detail below with reference to the drawings.

(A-1) Configuration According to First Embodiment

(A-1-1) Configuration of Image Forming Apparatus

Figure 1:
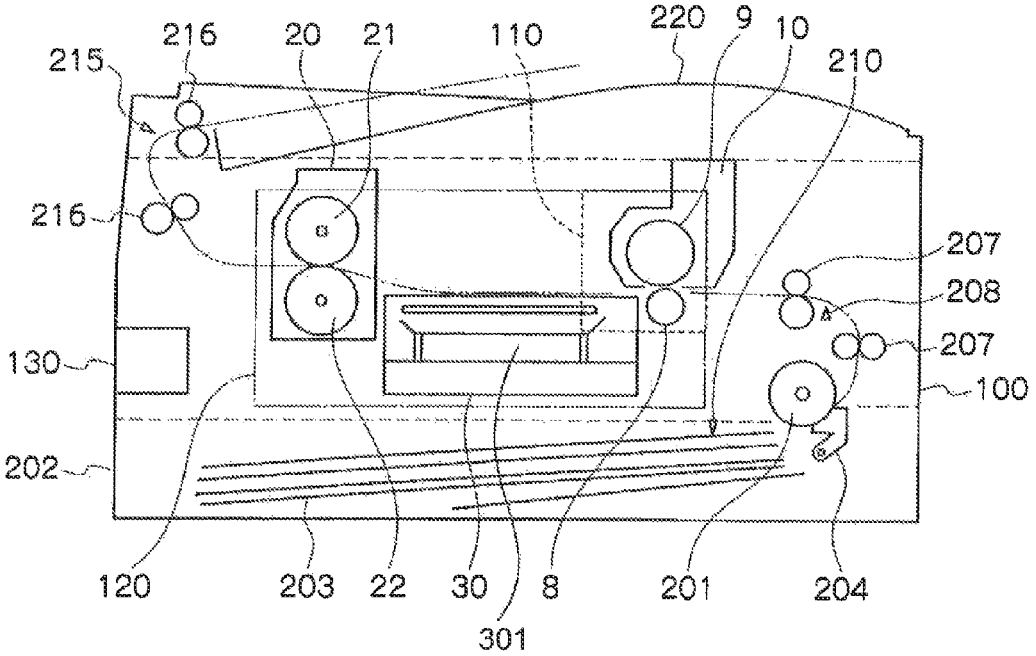
FIG. 1 is an internal configuration diagram of an internal configuration of an image forming apparatus according to a first embodiment.

FIG. 1 is an internal configuration diagram illustrating an internal configuration of the image forming apparatus 100 according to the first embodiment.

In FIG. 1, the image forming apparatus 100 includes a cassette part 202, a sheet supply roller 201, carrying rollers 207, a development device 110, an image fuser 20 that includes a heat application roller 21 and a pressure application roller 22, a controller 130, a separation frame part 204, a passage sensor lever 208, a medium exit sensor lever 210, an ejection sensor lever 215, ejection rollers 216, and a stacker 220.

The development device 110 forms a toner image (developer image) on a photosensitive drum 9 (electrostatic latent image carrier) based on image data, and transfers the toner image thereon to a medium 203. As shown in FIG. 1, the development device 110 includes a development unit 10 (development part) that includes the photosensitive drum 9 and a transfer roller 8 (transfer part).

An image forming part 120 includes the development device 110 and the image fuser 20 (fusion part) that includes the heat application roller 21 and the pressure application roller 22. FIG. 1 illustrates a case that the image forming part 120 includes the development device 110 and the image fuser 20 as well as a medium carrying device 30 between the development device 110 and the image fuser 20.

In FIG. 1, the image forming apparatus 100 according to the first embodiment is connected to a host device such as a personal computer (PC) and the like, receives image data and control information from the host device, and forms an image on the medium 203 based on the image data in accordance with the control information. The image forming apparatus 100 includes the controller 130 that controls an image formation process of the image forming apparatus 100.

The controller 130 is, for example, a device that is configured to include a microcomputer and the like. The controller 130 performs a power supply control to respective configuration elements, a motor drive control for rotating various rollers, a suction instruction of the medium 203 to the medium carrying device 30 and a print control based on sensor information from various sensors (for example, a medium exit sensor, a passage sensor, an ejection sensor) and the like.

In the image forming apparatus 100, when the image data is given from the host device, the image data is stored in a memory. Then, due to the control by the controller 130, the sheet supply roller 201 rotates and the media 203 put on the cassette part 202 are supplied.

At this time, while the sheet supply roller 201 supplies the media 203, the photosensitive drum 9, the transfer roller 8, the ejection rollers 216, a fan 301 (medium suction part) included in the medium carrying device 30, and the heat application roller 21 and the pressure application roller 22 included in the image fuser 20 start to rotate due to the control by the controller 130.

The media 203 that are supplied by the sheet supply roller 201 are given to the separation frame part 204. The separation frame part 204 separates each of the media 203. Each medium 203 is carried toward the downstream of a medium carrying path by the rotation of the sheet supply roller 201. Here, in the medium carrying path of the medium 203, the cassette 202 side is the upstream, and the stacker 220 side is the downstream.

The medium 203 that has been separated by the separation frame part 204 is sent to two pairs of the carrying rollers 207. The medium 203 is carried by the rotation of the lower pair of the carrying rollers 207 of the two pairs of the carrying rollers 207. The passage sensor lever 208 detects arrival of a leading edge of the carried medium 203.

The development unit 10 forms on the photosensitive drum 9 the toner image of the image that is to be formed onto the medium 203 when the medium 203 is detected by the passage sensor lever 208. That is, the development unit 10 forms the toner image on the surface of the photosensitive drum 9 based on the image date stored in the memory.

When the medium 203 that is carried by the carrying rollers 207 is given to the development unit 10, the photosensitive drum 9 and the transfer roller 8 rotate, and the toner image on the surface of the photosensitive drum 9 is transferred to the medium 203 in the development device 110.

When the toner image is transferred to the medium 203 in the development device 110, the medium 203 is carried to the image fuser 20 on the downstream side of the carrying path by the medium carrying device 30. For example, the medium carrying device 30 includes a medium suction part such as the fan 301 and the like. The curled medium 203 is sucked into the carrying path by a suction force of the medium suction part.

In the image fuser 20, a fix process is performed on the carried medium 203 by the heat application roller 21 and the pressure application roller 22.

After the fusion process has been performed by the image fuser 20, the medium 203 is carried by the rotating ejection rollers 216, and is ejected on the stacker 220 provided on the upper surface of the image forming apparatus 100. Thereby, the printing process in the image forming apparatus 100 ends.

(A-1-2) Configuration of Development Device 110

Next, a configuration of the development device 110 is explained with reference to the drawings.

Figure 2:
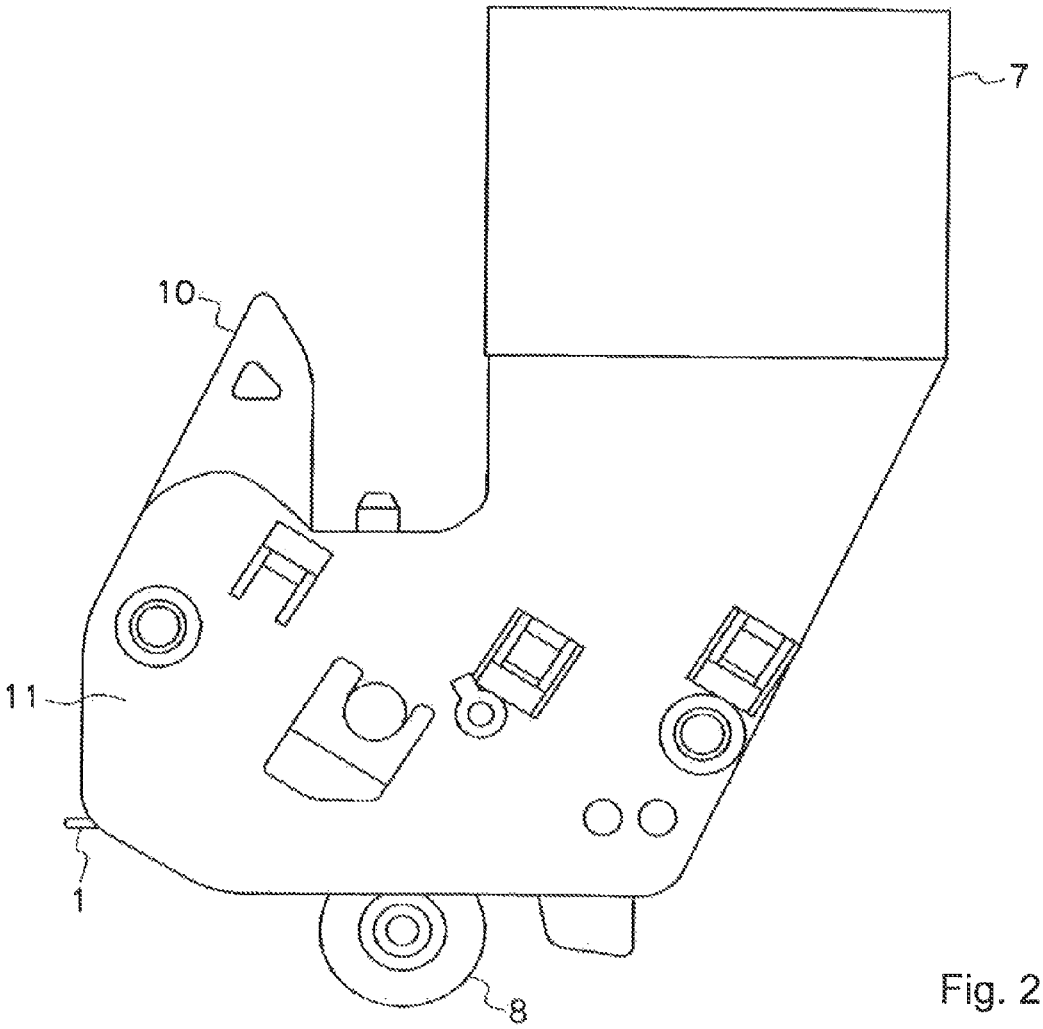
FIG. 2 is an external side view of an external side surface of a development device according to the first embodiment.

FIG. 2 is an external side view of an external side surface of the development device 110. In FIG. 2, the development device 110 includes a toner container 7 that accommodates and seals toner, the housing 11 that covers the development unit 10, a guide plate 1 (guide part), which is provided on the carrying downstream side of the housing 11 and is disposed to face the carrying path, and the transfer roller 8.

Figure 3:
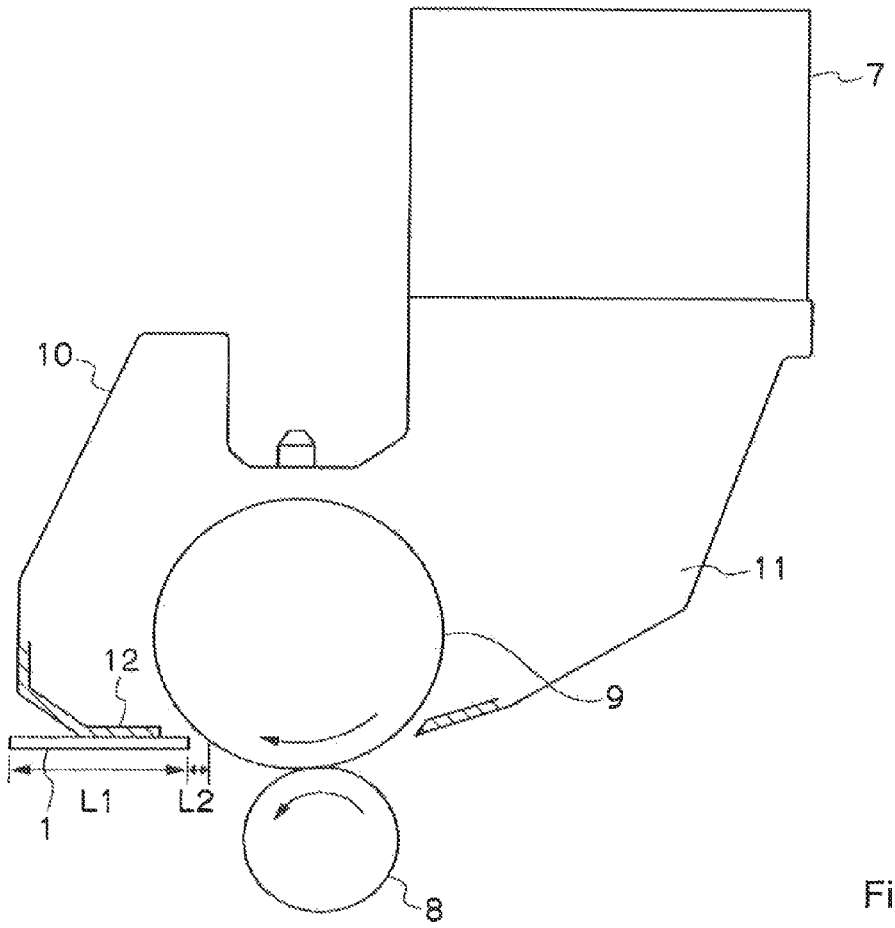
FIG. 3 is a cross-sectional view of an internal configuration of the development device according to the first embodiment.

FIG. 3 is a cross-sectional view of an internal configuration of the development device 110. In FIG. 3, the development unit 10 includes the photosensitive drum 9 in the housing 11. In FIG. 3, an arrow illustrated on the photosensitive drum 9 indicates a rotation direction of the photosensitive drum 9. In addition, an arrow illustrated on the transfer roller 8 in FIG. 3 indicates a rotation direction of the transfer roller 8.

The guide plate 1 is a plate that contacts a horizontal contact part 12 of the housing 11 on the carrying downstream side. In a case that the curled medium 203 is exited from the photosensitive drum 9 and the transfer roller 8, the guide plate 1 contacts the leading edge of the curled medium 203 to regulate the medium 203 not to contact the housing 11. Thereby, the conventional scrape of the image that occurs when the medium 203 that intensely curled in the upper direction contacts the housing 11 is prevented.

Various methods may be applied in installation methods of the guide plate 1 as long as the curled medium 203 is prevented from contacting the housing 11. For example, the methods may be applied as shown in FIG. 3.

For example, as shown in FIG. 3, the development unit 10 includes a contact part 12 in approximately horizontal direction as the configuration of the housing 11 on the carrying downstream side. The guide plate 1 is provided so that one surface of the guide plate 1 contacts the contact part 12 of the housing 11. The guide plate 1 is adhered to the contact part 12 by adhesion members or the like, for example. Alternatively, the guide plate 1 may also be removed from the contact part 12 by providing fitting parts or the like, for example.

In addition, materials of the guide plate 1 are not especially limited, and may be resin members, for example, polyester, or polyethylene terephthalate (PET) and the like, or may be metal materials.

Moreover, as shown in FIG. 3, the guide plate 1 is provided so that a gap between one end part (right end part in FIG. 3) of the guide plate 1 and the photosensitive drum 9 is minimized as much as possible. This is to avoid the leading edge of the medium 203 entering between the photosensitive drum 9 and the guide plate 1. For example, in FIG. 3, when a length between a point at which an extension line of the guide plate 1 contacts the photosensitive drum 9 and the one end part of the guide plate 1 is defined as L2, the length L2 is preferably approximately 1 mm to 3 mm, and is especially preferably approximately 1 mm.

In addition, a length of the guide plate 1 in the medium carrying direction is a length to the extent that the leading edge of the medium 203 is removed from the guide plate 1 by the weight of the medium 203. For example, in the example of the first embodiment, when the length of the guide plate 1 in the medium carrying direction is defined as L1, the length L1 is preferably approximately 10 mm to 15 mm.

Figure 4:
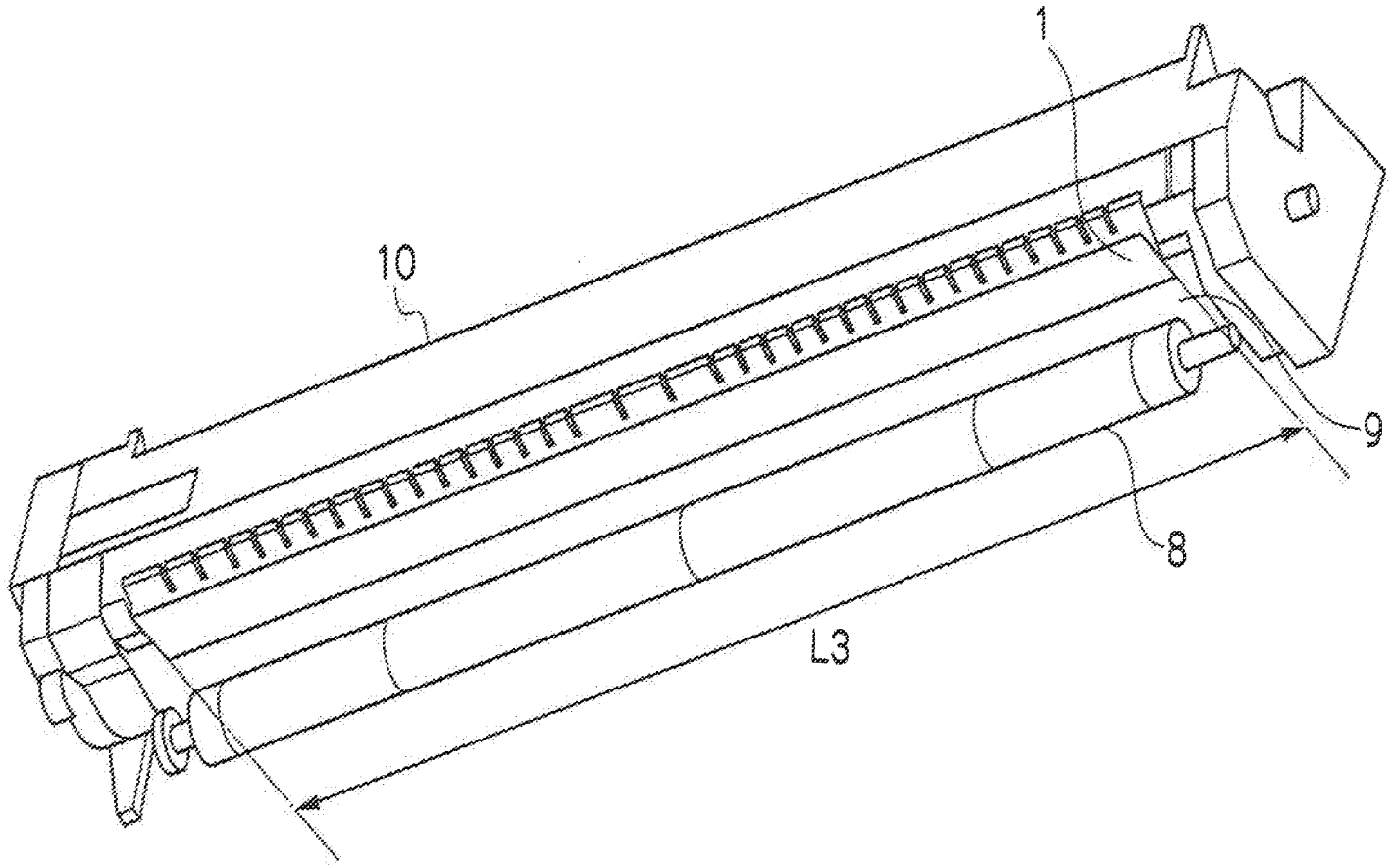
FIG. 4 is an external perspective view of the development device according to the first embodiment seen from a lower side.

FIG. 4 is an external perspective view of the development device 110 seen from the lower side. As shown in FIG. 4, a length L3 of the guide plate 1 in the long side is approximately the same as that of the transfer roller 8 in the longitudinal direction, and may be approximately 250 mm to 350 mm, for example.

(A-2) Operation in First Embodiment

Next, an operation of the development device 110 in the image forming apparatus 100 according to the first embodiment is explained with reference to the drawings.

Figure 5A:
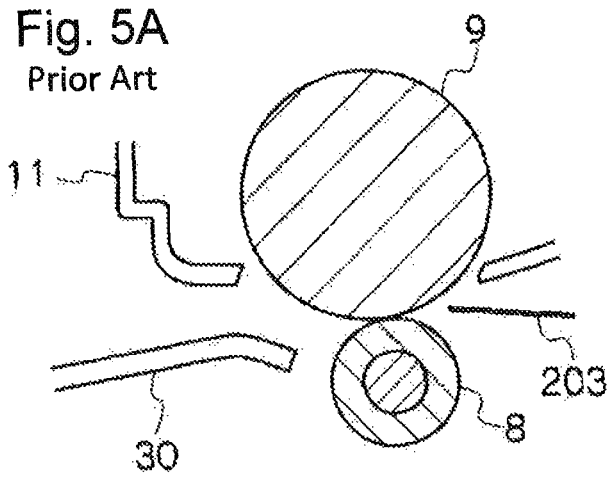
Fig. 5A Prior Art
FIGS. 5A-5C are explanatory diagrams for explaining the carrying of a medium in a case when a curl is not generated in a conventional image forming apparatus.
Figure 5B:
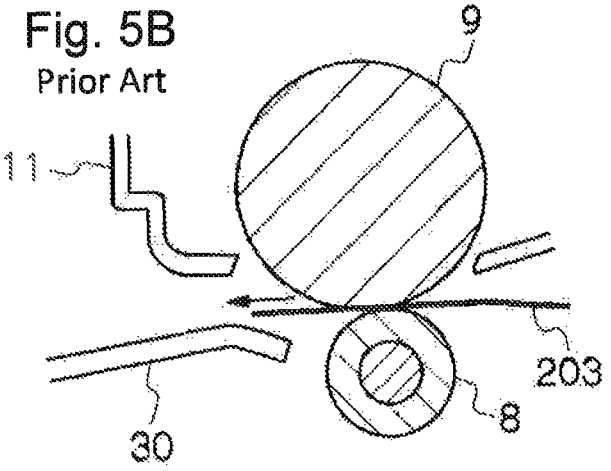
Fig. 5B Prior Art
Figure 5C:
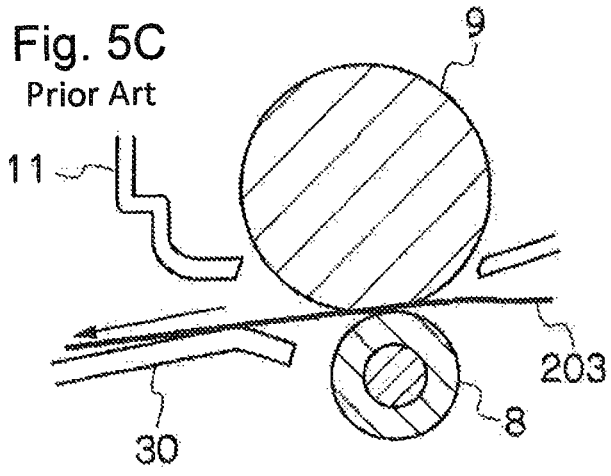
Fig. 5C Prior Art

FIGS. 5A-5C are explanatory diagrams for explaining the carrying of the medium 203 in the case when a curl is not generated in a conventional image forming apparatus.

In FIGS. 5A-5C, in the case that the curl has not been generated on the medium 203, when the medium 203 is carried to the development unit 10 (see FIG. 5A), the toner image is transferred onto the medium 203 while the medium 203 is sandwiched and carried by the photosensitive drum 9 and the transfer roller 8 (see FIG. 5B). Accordingly, the medium 203 is exited from the development device 110 to the medium carrying device 30, and is carried to the image fuser 20 (see FIG. 5C).

FIGS. 6A-6F are explanatory diagrams for explaining the carrying of the medium 203 in the case when the curl is generated in the conventional image forming apparatus.

Figure 6A:
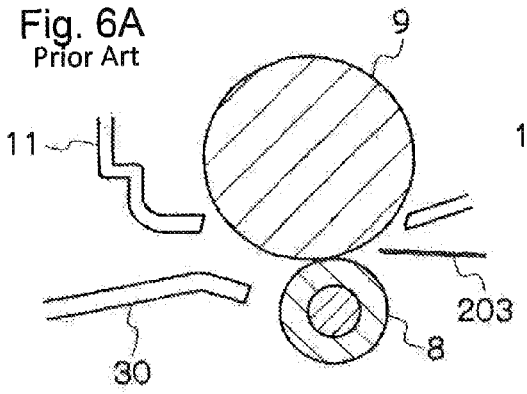
Fig. 6A Prior Art
FIGS. 6A-6F are explanatory diagrams for explaining the carrying of a medium in a case when the curl is generated in the conventional image forming apparatus.
Figure 6D:
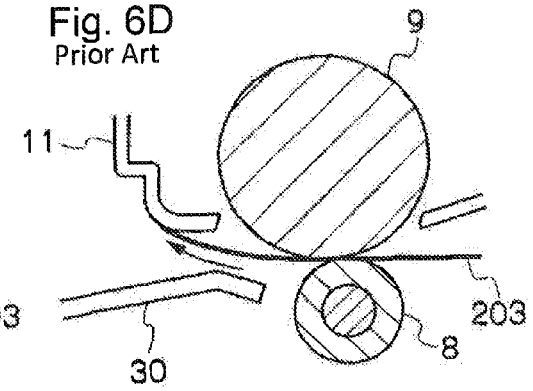
Fig. 6D Prior Art
Figure 6B:
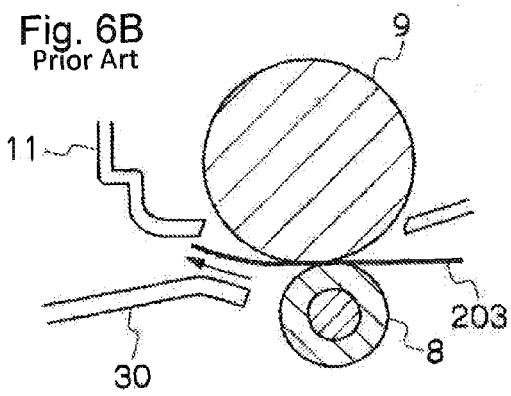
Fig. 6B Prior Art
Figure 6E:
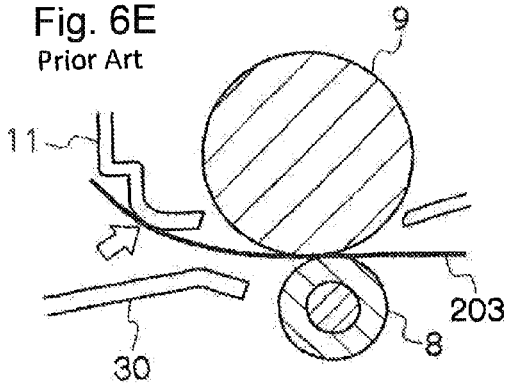
Fig. 6E Prior Art

In FIGS. 6A-6F, in the case that the curl has been generated, when the medium 203 is carried to the development unit 10 (see FIG. 6A), the toner image is transferred onto the medium 203 while the medium 203 is sandwiched and carried by the photosensitive drum 9 and the transfer roller 8 (see FIG. 6B).

Figure 6C:
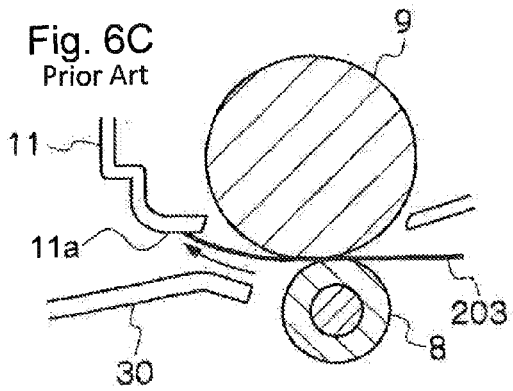
Fig. 6C Prior Art
Figure 6F:
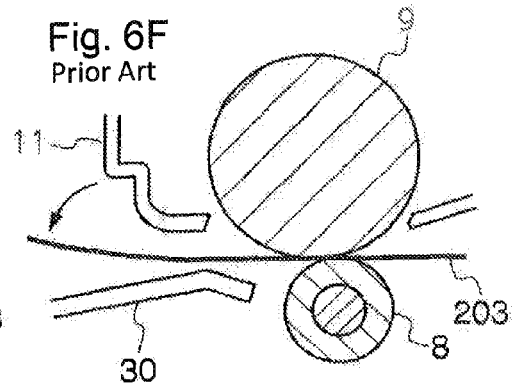
Fig. 6F Prior Art

When the medium 203 is sandwiched and carried by the photosensitive drum 9 and the transfer roller 8 and the curl has been generated on the medium 203, the leading edge of the curled medium 203 contacts a portion 11*a* in the housing 11 of the development unit 10 that covers the photosensitive drum 9 (see FIG. 6C).

Thereafter, when the medium 203 has been exited from the photosensitive drum 9 and the transfer roller 8, the curled leading edge of the medium 203 moves while scraping the bottom part of the housing 11 of the development unit 10 (see FIG. 6D). As a result, the unfixed toner image on the surface of the curled medium 203 is scraped by the housing 11 of the development unit 10 (see FIG. 6E). That is, the scrape of the image occurs by the unfixed toner image on the medium 203 being scraped.

Furthermore, as the exit of the medium 203 proceeds, the curvature of the medium 203 becomes larger due to the weight of the medium 203. Thereby, the portion of the medium 203 that has contacted the housing 11 separates from the housing 11, and the medium 203 is exited as is (see FIG. 6F).

As mentioned above, in the conventional image forming apparatus, once the curl occurred, portions any other than the leading edge of the medium 203 contacts the bottom of the housing 11. As a result, the image on the portions, which has been scraped with the housing 11, is scraped.

FIGS. 7A-7F are explanatory diagrams for explaining the carrying of the medium 203 in the case when the curl has been generated in the image forming apparatus 100 that includes the guide plate 1 according to the first embodiment.

Figure 7A:
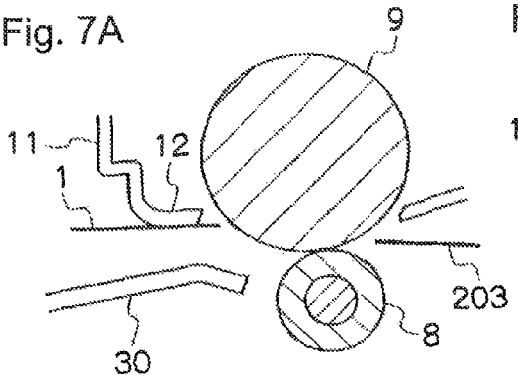
FIGS. 7A-7F are explanatory diagrams for explaining the carrying of the medium in the case when the curl has been generated in the image forming apparatus that includes a guide plate according to the first embodiment.
Figure 7D:
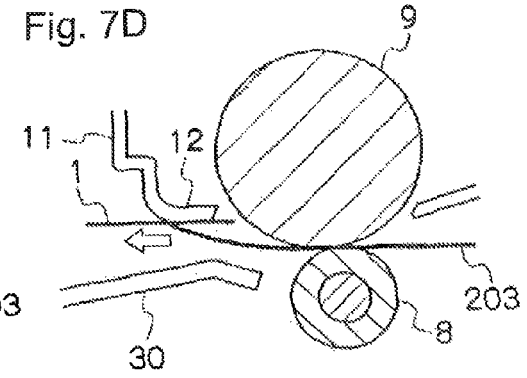
Figure 7B:
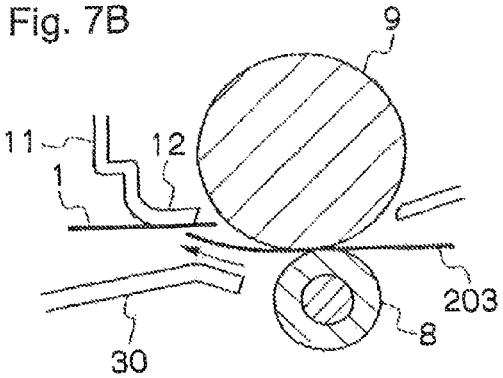
Figure 7E:
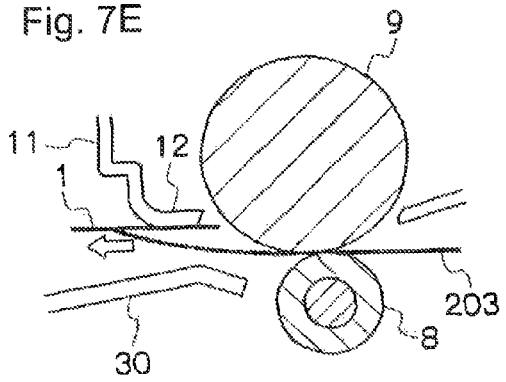

In FIGS. 7A-7F, when the medium 203 is carried to the development unit 10 (see FIG. 7A), the toner image is transferred onto the medium 203 while the medium 203 is sandwiched and carried by the photosensitive drum 9 and the transfer roller 8 (see FIG. 7B).

Figure 7C:
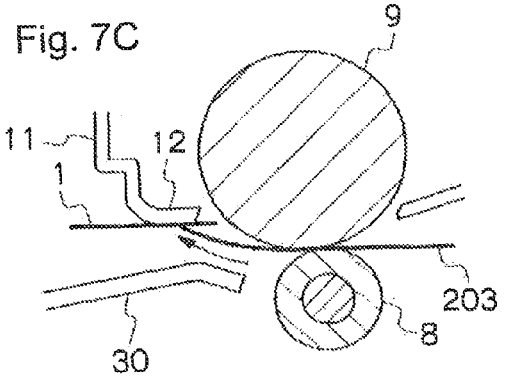
Figure 7F:
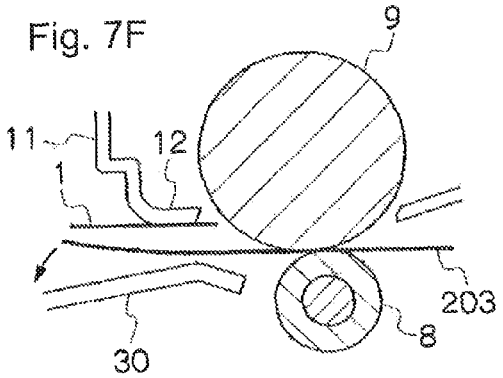

When the medium 203 is sandwiched and carried by the photosensitive drum 9 and the transfer roller 8 and the curl has been generated on the medium 203, the curled leading edge of the medium 203 contacts the guide plate 1 (see FIG. 7C).

Thereafter, when the medium 203 has been exited from the photosensitive drum 9 and the transfer roller 8, while the curled leading edge of the medium 203 scrapes the guide plate 1, the medium 203 moves in the downstream direction (see FIG. 7D). As the medium 203 travels after passing the photosensitive drum 9, the leading edge of the medium 203 moves upward in the drawing for a while.

Furthermore, as the exit of the medium 203 proceeds, the curvature of the medium 203 becomes larger due to the weight of the medium 203. Also, in this time, the leading edge of the medium 203 moves simultaneously with contacting the guide plate 1 (see FIG. 7E).

In this time, since the surface of the medium 203 is concave due to the curl, only the leading edge of the medium 203 contacts the guide plate 1, the portion on the surface of the medium 203 on which the image is transferred does not contact the guide plate 1.

Then, as the curled leading edge of the medium 203 moves along the guide plate 1, the curvature of the medium 203 becomes larger due to the weight of the medium 203. As a result, the leading edge of the medium 203 that has contacted the guide plate 1 separates from the guide plate 1 and the medium 203 is exited as it is (see FIG. 7F).

(A-3) Effects of First Embodiment

As mentioned above, according to the first embodiment, the leading edge of the medium is received by the surface of the guide plate and the medium moves to the carrying direction by providing the guide plate on the medium exit side of the housing of the development unit. As a result, according to the first embodiment, even when the curled medium is exited from the development device, a phenomenon where the medium surface contacts the housing of the development device and thereby the image scrape occurs is prevented.

In addition, according to the first embodiment, by making a length of the guide plate in the medium carrying direction a length to the extent that the leading edge of the medium separates the guide plate 1 by the weight of the medium, the transfer surface does not contact the guide plate while the leading edge of the medium is received by the surface of the guide plate, since the transfer surface of the medium is concave due to the curl. Accordingly, the image scrape is prevented.

(B) Second Embodiment

Next, a development device and an image forming apparatus according to a second embodiment of the present invention are explained with reference to the drawings.

(B-1) Configuration According to Second Embodiment

A difference of the second embodiment from the first embodiment is that lengths of guide plates in the medium carrying direction are extended from the development unit to the vicinity of the image fuser. Other configurations are the same as those of the first embodiment. Thereafter, characteristic configurations of the second embodiment are mainly explained.

Figure 8:
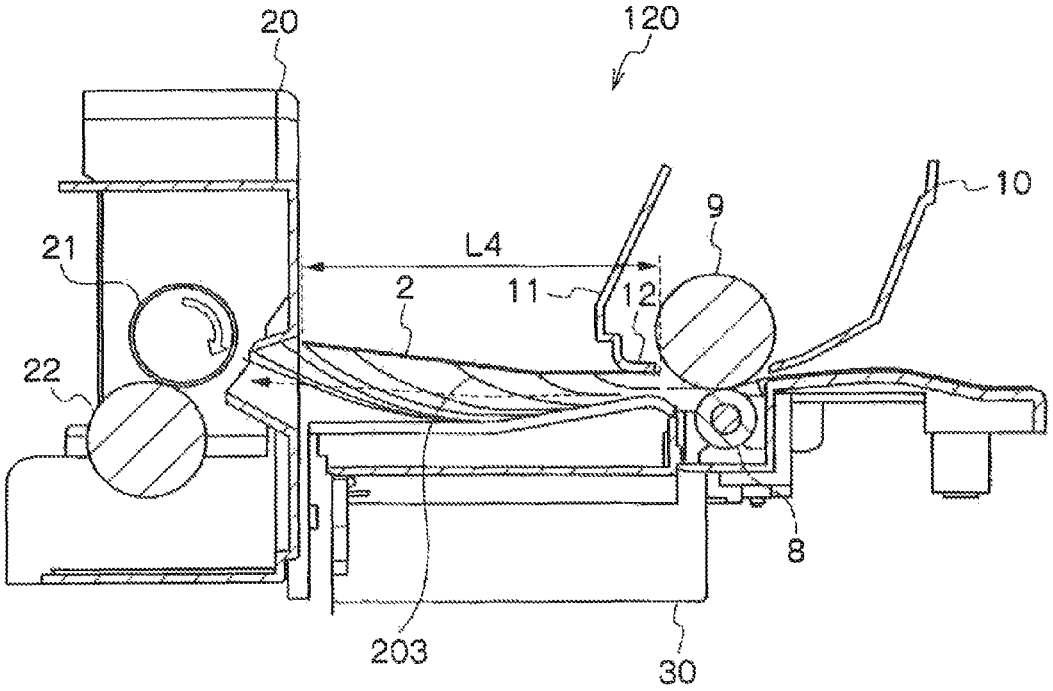
FIG. 8 is a cross-sectional view of an image forming part of the image forming apparatus according to a second embodiment and an explanatory diagram for explaining the movement of a medium (Part 1).

FIG. 8 is a first cross-sectional view of the image forming part 120 of the image forming apparatus 100 according to the second embodiment and an explanatory diagram for explaining the movement of the medium.

In the FIG. 8, the image forming part 120 of the second embodiment includes the development unit 10 that includes the photosensitive drum 9, the transfer roller 8, the medium carrying device 30 and the image fuser 20 that includes the heat application roller 21 and the pressure application roller 22 in the same manner as the first embodiment.

A guide plate 2 is provided so as to contact the contact part 12 on the carrying downstream side of the housing 11 of the development unit 10. The guide plate 2 only needs contact the contact part 12 in the same manner as the first embodiment. For example, similar to the first embodiment, the guide plate 2 may be adhered to the contact part 12 by adhesion members and the like. The guide plate 2 may also be configured removable from the contact part 12 by providing fitting parts and the like, for example.

The guide plate 2 guides the carrying of the medium 203 from the vicinity of an exit position in the development unit 10 to the vicinity of an entrance position in the image fuser 20. By extending the guide plate 2 to the vicinity of the entrance position in the image fuser 20, a curled medium 203 is accurately carried to the image fuser 20. In addition, the guide plate 2 may be provided so that an end part of the guide plate 2 contacts the housing of the image fuser 20.

The length L4 of the guide plate 2 in the carrying direction depends on the positional relationship between the development unit 10 and the image fuser 20, and may be, for example, approximately 180 mm to 220 mm.

In addition, the guide plate 2 is provided so that a carrying space (space configured by the guide plate 2 and the upper surface of the medium carrying device) of the medium 203 widens along the carrying direction (that is, a direction from the upstream to the downstream).

For example, in the example in the FIG. 8, the guide plate 2 is provided so as to extend in the horizontal direction by a predetermined length from the exit position of the medium 203 in the development unit 10, and thereafter to extend in an obliquely upward direction along the carrying direction. Alternatively, the guide plate 2 may be provided so as to have an incline extending in an obliquely upward direction from the development unit 10 to the image fuser 20 without an interval extending in the horizontal direction.

In addition, in the example in the FIG. 8, a following case is illustrated. The interval length of the guide plate 2 in the horizontal direction is about ⅓ of the entire length. The interval length of the guide plate 2 in the obliquely upward direction is about ⅔ of the entire length. The interval length in the horizontal direction and the interval length in the obliquely upward direction are not limited especially, and may be determined according to the configuration of the image forming apparatus 100.

(B-2) Operation in Second Embodiment

Next, an operation of the development device 110 in the image forming apparatus 100 according to the second embodiment is explained with reference to the drawings.

The operation of the development device 110 according to the second embodiment is basically the same as that of the first embodiment. The movement of the medium 203 provided with the guide plate 2 of the second embodiment is mainly explained below.

Figure 9:
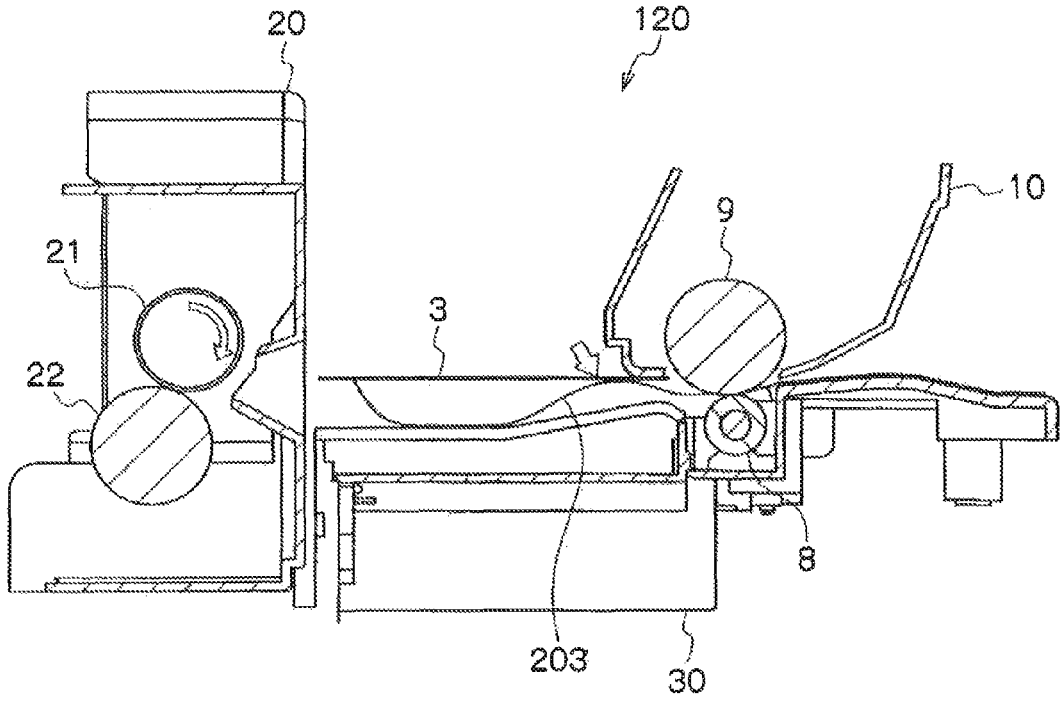
FIG. 9 is a cross-sectional view of the image forming part of the image forming apparatus according to the second embodiment and an explanatory diagram for explaining the movement of the medium (Part 2).

FIG. 9 is a second cross-sectional view of the image forming part 120 of the image forming apparatus 100 according to the second embodiment and an explanatory diagram for explaining the movement of the medium.

A difference of the image forming part 120 shown in FIG. 9 from the image forming part 120 shown in FIG. 8 is that the guide plate 2 shown in FIG. 8, as discussed above, extends in the obliquely upward direction so that the carrying space of the medium 203 widens, while a guide plate 3 shown in FIG. 9 extends in the horizontal direction to the vicinity of the entrance position in the image fuser 20.

The curled medium 203 can be exited from the development unit 10. At this time, a large curl may be generated on the entire medium. For example, there is a case that the medium 203, such as a recycled sheet or special sheet and the like, is used, on which different fabrication processes are performed on the back surface and the front surface on the sheet. Since the stretch of the back surface and the front surface are significantly different, a curl may be generated on the entire medium.

In such a case, the leading edge of the medium does not falls by the weight of the medium 203 and the medium 203 can move with the leading edge contacting the guide plate.

In a case that guide plate 3 shown in FIG. 9 extends in the horizontal direction, the entire medium 203 on which the large curl has generated moves in the carrying direction with the leading edge thereof contacting the guide plate 3.

However, as shown in FIG. 9, in a duct-shaped carrying space that is sandwiched by the guide plate 3 and the medium carrying device 30, since the large curl has been generated on the entire medium, the leading edge of the medium 203 is pushed into a narrow space, the medium 203 warps near the center part thereof. Accordingly, the surface of the medium 203 near the center part (portion indicated by the arrow) contacts the guide plate 3 and an unfixed toner image on the portion thereof may be scraped.

On the other hand, in the case that the guide plate 2 shown in FIG. 8 is provided so that the carrying space widens toward the carrying direction. Since the narrow space widens in the carrying direction of the medium 203, the warping of the medium 203 is moderated. Accordingly, the surface of the medium 203 near the center part does not contact the guide plate 3 and the unfixed toner image on the portion thereof is prevented from being scraped.

(B-3) Effects of Second Embodiment

As mentioned above, according to the second embodiment, by connecting the upper parts of the carrying path of the medium from the development unit to the image fuser and widening the carrying path from the upstream to the downstream of the carrying of the medium, the image scrape on the entire medium on which the large curl has generated is prevented.

(C) Other Embodiments

In the above-discussed first and second embodiments, the guide plates that guide a carrying path from the development device that includes the photosensitive drum and the transfer roller to the image fuser are exemplified. However, the above-mentioned guide plates may be applied in devices/method in which the surfaces of the media are not scraped.

Figure 10:
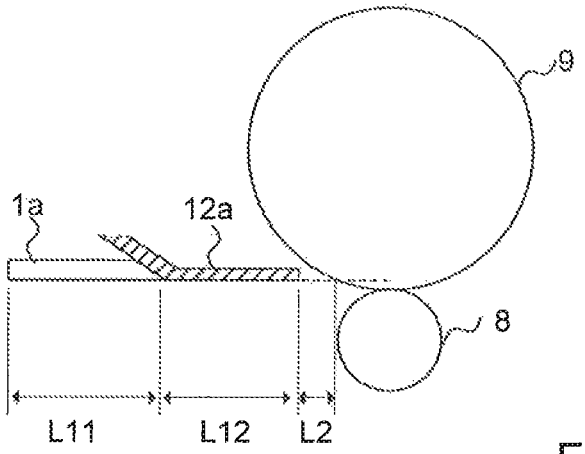
FIG. 10 is an enlarged cross-sectional view of an internal configuration of a modified embodiment.

In the above-discussed first embodiment, it is disclosed that the guide plate as a guide part is provided as an independent part to the housing of the development unit. Herein, the guide plate extends straight along the carrying direction of the medium. It is noted that providing the guide part as a different part from the housing bring an advantage that is an easy adjustment of the distance between the guide part and the rollers. However, as a modified embodiment, a shape of the contact portion of the housing (for example, 11*a* in FIG. 6C) itself may be made to extend along the carrying direction of the medium. Namely, in the invention, it is not necessary to form the guide part and the housing separately. It may be practical to integrate the guide part with the housing as long as the guide part functions. On the other hand, the guide part may be configured with two or three components. For example, a first part is on the upstream side and a second part on the downstream side. In addition, it is also practical, as shown in FIG. 10, a upstream part with a length L12 is realized with a part 12*a* of housing. A downstream part with a length L11 is realized with the guide plate 1*a*. Further, the guide part does not necessarily have a plate shape as long as it functions to guide the leading edge of the medium. For example, the guide part may be configured with two to five rails that are arranged in substantially parallel each other along in the carrying direction of the medium. The outer two rails are arranged with a space that is a little narrower than the width of the medium. According to a degree of hardness of the medium, a sole rail may be used as the guide part, which is arranged in a middle of the carrying path with respect to the width direction because a width curl of the medium can be ignored. The width curl means a curl occurring in the width direction of the medium.

In the image forming apparatus shown in the above-discussed first and second embodiments may be any of various devices such as printers, multifunction peripherals (MFP) and the like that form an image on the medium, for example.

Regarding the guide plate shown in the above-discussed second embodiment, the guide plate that extends in the obliquely upward direction in the delivery direction is exemplified as one example of the case that the guide plate is disposed so that the carrying space widens along the carrying direction. The configurations of the guide plates are not limited to such a configuration. For example, as another configuration, a guide plate may have a curved shape that is a downward concave by a predetermined curvature.

What is claimed is:

1. A development device, comprising:

a housing having a bottom part that extends in substantially parallel with a medium carrying direction;

a development part provided in the housing and configured to develop a developer image on a surface of an electrostatic latent image carrier based on an image signal;

a transfer part configured to transfer the developer image to a medium; and a guide part having a first edge and a second edge that is opposite from the first edge, the first edge and the second edge extending in a direction perpendicular to the medium carrying direction and in parallel with the development part, the guide part being configured to regulate a contact of the medium, on which the developer image has been transferred and been exited, to the housing, and to guide the medium to a carrying path, wherein the transfer part has a width in the direction perpendicular to the medium carrying direction, and the guide part is a rectangular shape member that is fixedly attached to an exit side of the bottom part of the housing and that is disposed to face the carrying path along the transfer part in a region corresponding to the entire width of the transfer part, the guide part is wider in the medium carrying direction than a width of the exit side of the bottom part of the housing, such that the first edge of the guide part extends further towards an upstream side of the medium carrying direction than an upstream side edge of the bottom part, and that the second edge of the guide part extends further towards a downstream side of the medium carrying direction than a downstream side edge of the bottom part, the first edge and the second edge of the guide part each have a length in the direction perpendicular to the medium carrying direction that is substantially the same as a length of the development part.

2. The development device of claim 1, wherein the first edge of the guide part is located to be close to the electrostatic latent image carrier.

3. The development device of claim 2, wherein the first edge of the guide part is located with a gap of 1 mm to 3 mm from the electrostatic latent image carrier.

4. The development device of claim 1, wherein a width of the guide part in the medium carrying direction is 10 mm to 15 mm.

5. The development device of claim 1, wherein the guide part is made of resin.

6. The development device of claim 1, wherein the guide part extends from a vicinity of an exit position of the development part to a vicinity of an entrance position of a fusion part.

7. The development device of claim 6, wherein the guide part is disposed so that a carrying space of the medium widens along the medium carrying direction of the medium that is carried.

8. The development device of claim 1, wherein the guide part includes a first region formed at the first edge of the guide part and a second region that is formed at the second edge of the guide part and that extends from the first region, the first region is formed approximately in parallel with the carrying path, the second region is inclined diagonally upwardly from the first region, the first region is formed wider than the width of the exit side of the bottom part of the housing, and the diagonally inclined second region is formed longer in the medium carrying direction than the first region.

9. An image forming apparatus, comprising:

a housing having a bottom part that extends in substantially parallel with a medium carrying direction;

a development part provided in the housing and configured to develop a developer image on a surface of an electrostatic latent image carrier based on an image signal;

a transfer part configured to transfer the developer image to a medium;

a fusion part configured to fix the developer image that has been transferred to the medium on the medium; and a guide part having a first edge and a second edge that is opposite from the first edge, the first edge and the second edge extending in a direction perpendicular to the medium carrying direction and in parallel with the development part, the guide part being configured to regulate a contact of the medium, on which the developer image has been transferred and been exited, to the housing, and to guide the medium to a carrying path to the fusion part, wherein the transfer part has a width in the direction perpendicular to the medium carrying direction, and the guide part is a rectangular shape member that is fixedly attached to an exit side of the bottom part of the housing and that is disposed to face the carrying path along the transfer part in a region corresponding to the entire width of the transfer part, the guide part is wider in the medium carrying direction than a width of the exit side of the bottom part of the housing, such that the first edge of the guide part extends further towards an upstream side of the medium carrying direction than an upstream side edge of the bottom part, and that the second edge of the guide part extends further towards a downstream side of the medium carrying direction than a downstream side edge of the bottom part, the first edge and the second edge of the guide part each have a length in the direction perpendicular to the medium carrying direction that is substantially the same as a length of the development part.

10. The image forming apparatus of claim 9, wherein the first edge of the guide part is located to be close to the electrostatic latent image carrier.

11. The image forming apparatus of claim 10, wherein the first edge of the guide part is located with a gap of 1 mm to 3 mm from the electrostatic latent image carrier.

12. The image forming apparatus of claim 9, wherein a width of the guide part in the medium carrying direction is 10 mm to 15 mm.

13. The image forming apparatus of claim 9, wherein the guide part is made of resin.

14. The image forming apparatus of claim 9, wherein the guide part extends from a vicinity of an exit position of the development part to a vicinity of an entrance position of the fusion part.

15. The image forming apparatus of claim 14, wherein the guide part is disposed so that a carrying space of the medium widens along the medium carrying direction of the medium that is carried.

16. The image forming apparatus of claim 9, wherein the guide part extends from a side of the development part to a side of the fusion part and includes a first region formed at the first edge of the guide part on the side of the development part and a second region that is formed at the second edge of the guide part and that extends from the first region to the side of the fusion part, the first region is formed approximately in parallel with the carrying path, and the second region is inclined diagonally upwardly from the first region, the first region is formed wider than the width of the exit side of the bottom part of the housing, and the diagonally inclined second region is formed longer in the medium carrying direction than the first region.

* * * * *